US009945635B1

(12) United States Patent
Major

(10) Patent No.: US 9,945,635 B1
(45) Date of Patent: Apr. 17, 2018

(54) TRIGGER ARCHERY RELEASE WITH THUMB ASSIST

(71) Applicant: COBRA OUTDOORS LLC, Liverpool, PA (US)

(72) Inventor: Jarrod Burk Major, Liverpool, PA (US)

(73) Assignee: Cobra Outdoors LLC, Liverpool, PA (US)

( * ) Notice: Subject to any disclaimer, the term of this patent is extended or adjusted under 35 U.S.C. 154(b) by 0 days.

(21) Appl. No.: 15/697,642

(22) Filed: Sep. 7, 2017

Related U.S. Application Data

(63) Continuation of application No. 15/646,858, filed on Jul. 11, 2017.

(60) Provisional application No. 62/361,148, filed on Jul. 12, 2016.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | | |
|---|---|---|---|---|
| 4,691,683 | A * | 9/1987 | Peck | F41B 5/1469 124/35.2 |
| 5,027,786 | A * | 7/1991 | Peck | F41B 5/1469 124/35.2 |
| 5,103,796 | A * | 4/1992 | Peck | F41B 5/1469 124/35.2 |
| 7,926,475 | B2 * | 4/2011 | Jones | F41B 5/1469 124/35.2 |
| 9,255,762 | B2 | 2/2016 | Kelly et al. | |
| 9,285,183 | B2 * | 3/2016 | Rentz | F41B 5/1469 |
| 2017/0089663 | A1 * | 3/2017 | Horn | F41B 5/1469 |

* cited by examiner

*Primary Examiner* — John Ricci
(74) *Attorney, Agent, or Firm* — Hooker & Habib, P.C.

(57) ABSTRACT

A trigger release for archery includes a thumb assist that enables the thumb of the archer holding the release to apply force assisting in drawing and holding the bowstring under tension.

17 Claims, 3 Drawing Sheets

10
12
16
18
20
22
24
26
28
30
32
34
36
38
40
42

TRIGGER ARCHERY RELEASE WITH THUMB ASSIST

RELATED APPLICATION

This application is a continuation-in-part of and claims priority to my pending non-provisional U.S. patent application Ser. No. 15/646,858 "Trigger Archery Release with Thumb Assist" filed Jul. 11, 2017, which non-provisional patent application in turn claims priority to my U.S. Provisional Patent Application No. 62/361,148 "Archery Finger Trigger Release with Thumb Assist Grip" filed Jul. 12, 2016, both priority applications being incorporated by reference as if fully set forth herein.

FIELD OF THE DISCLOSURE

The disclosure relates generally to an archery release, and in particular to a trigger release.

BACKGROUND OF THE DISCLOSURE

Archery releases hold a bowstring while an archer is pulling on the release to draw the bowstring. The archery release enables the archer to smoothly and consistently draw back the bowstring and release the bowstring for consistent and repeatable arrow flight.

Common archery releases include the back-tension release and the trigger release.

A back-tension release typically includes a rigid handle, a release head, and a pawl release mechanism mounted in the release head that is actuated by displacement of the release. The archer's fingers gripping the handle remain stationary on the handle during the draw to prevent premature release of the bowstring. Slight rotation of the back-tension release causes the pawl mechanism to disengage the bowstring and shoot the arrow.

For example, the back-tension release disclosed in Kelly et al. U.S. Pat. No. 9,255,762 discloses a back-tension release in which a distal end of the rigid handle is moved in a backwards direction to generate the rotation needed for releasing the bowstring. A thumb barrel is attached near the opposite end of the handle and is pressed against by the archer's thumb to initiate the rotation of the release.

A trigger release includes a trigger mechanism having an exposed trigger that typically actuate a hook or jaws movably connected to the release head. The archer engages the trigger with a finger of the hand holding the handle to disengage the bowstring. A trigger release in typical embodiments is designed for actuation by the thumb (a thumb trigger release) or by the index finger (an index finger trigger release) in moving or tripping the trigger.

Because a trigger release is actuated by displacement of the trigger and not displacement of the release itself, known trigger releases do not include a thumb barrel for generating rotation of the release.

SUMMARY OF THE DISCLOSURE

Disclosed is an improved finger trigger release that includes a thumb assist. The thumb assist is similar to the thumb barrel used in some back-tension releases but enables the thumb to assist in generating draw force while drawing the bowstring.

Conventional finger trigger releases do not include a thumb assist. The release is triggered by moving the thumb or index finger against the trigger. Rotation of the handle alone does not trigger the release so a "thumb barrel"-like structure offers no advantage or benefit in triggering a finger trigger release.

The applicant has found, however, that placing the thumb against the thumb assist while drawing the bowstring with the improved finger release provides for a smoother, greater draw while still maintaining consistent release of the bowstring—even if the thumb is required to move off the thumb assist to engage the trigger and release the bowstring.

Other objects and features of the disclosure will become apparent as the description proceeds, especially when taken in conjunction with the accompanying drawing sheets illustrating one or more illustrative embodiments.

DETAILED DESCRIPTION

Figures 1, 2, 3, 4:
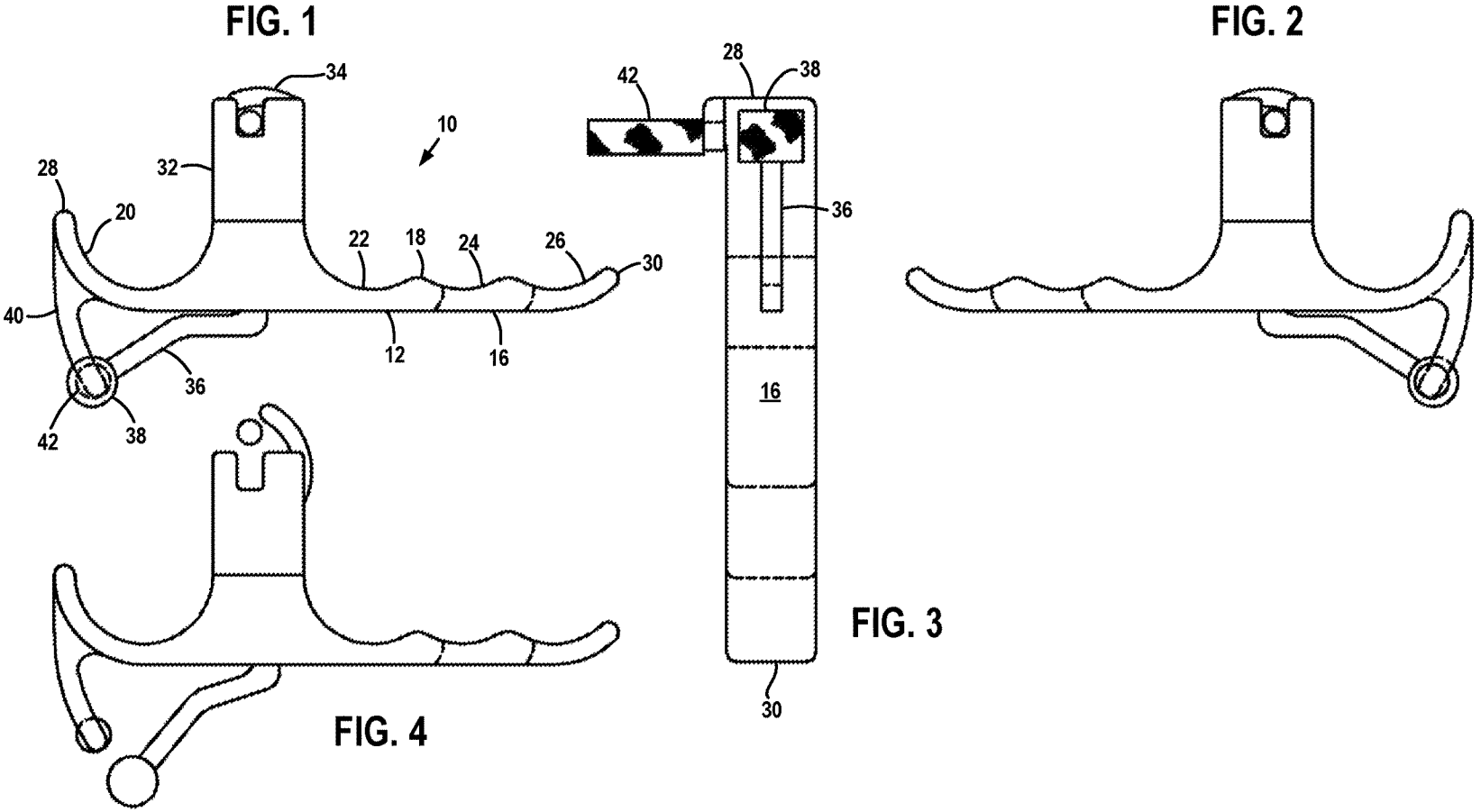
FIG. 1 is a top view of a thumb trigger release in accordance with the disclosure, the release being in an engaged position and retaining a bowstring.
FIG. 2 is a bottom view of the thumb trigger release shown in FIG. 1.
FIG. 3 is a back view of the thumb trigger release shown in FIG. 1.
FIG. 4 is a top view similar to FIG. 1 but with the thumb trigger release in the released state for releasing the bowstring.
Figure 6:
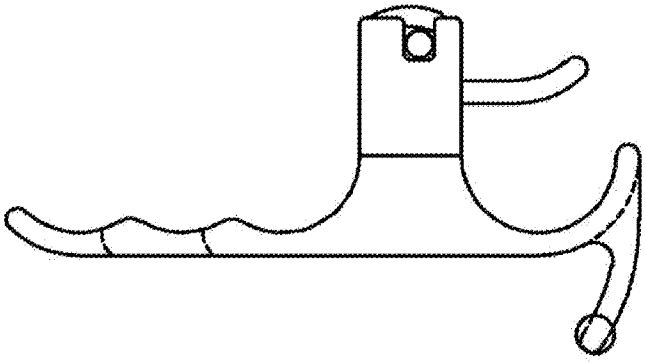
FIG. 6 is a bottom view of the index finger trigger release shown in FIG. 5.
Figure 5:
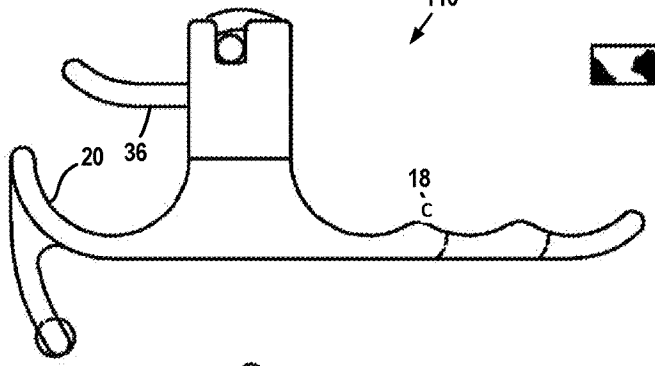
FIG. 5 is a top view of an index finger trigger release in accordance with the disclosure, the release being in an engaged position and retaining a bowstring.
Figure 7:
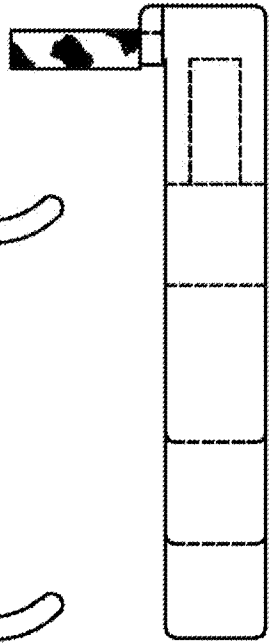
FIG. 7 is a back view of the index finger trigger release shown in FIG. 5.
Figure 8:
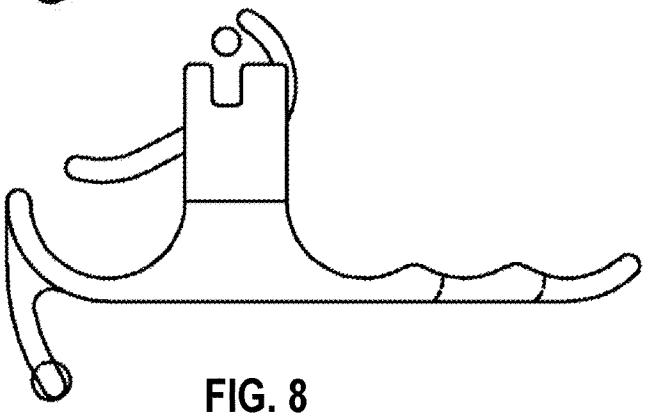
FIG. 8 is a top view similar to FIG. 5 but with the index finger release in the released state for releasing the bowstring.

FIGS. 1-4 illustrate a thumb trigger release 10 having a thumb assist 12 in accordance with this disclosure.

The illustrated thumb trigger release 10 is a conventional thumb trigger release sold by Jim Fletcher Archery, Bodfish, Calif. under the JIMI T trademark as modified by the teachings of this disclosure.

The thumb trigger release 10 includes a body formed as a handle 12 that extends along a longitudinal axis 14. The handle has opposite front and back sides 16, 18 respectively on opposite sides of the axis 14. Finger grips 20, 22, 24, 26 are spaced axially along the front side of the handle. The finger grips are concave shaped in a conventional manner which crests separating adjacent finger grips. The finger grips include the index finger grip 20 disposed at an upper end 28 of the handle and respective middle finger grip 22, ring finger grip 24, and little finger grip 26 extending from the index finger grip to the lower end 30 of the handle.

Extending away from the front side 16 of the handle 12 transverse to the handle axis 14 is a release head 32 located between the index finger grip 20 and the middle finger grip 22. A trigger mechanism 32 is partially disposed in the release head and includes a pivoting bowstring hook 34 located at the free end of the release head, a thumb trigger 36 extending away from the handle 12 out the handle back side 18, and a generally cylindrical trigger post 38 located at the free end of the thumb trigger 36. The trigger post 38 is rigidly attached to the thumb trigger 36 to be pushed by the archer's thumb for actuating the thumb trigger and releasing the drawstring. The trigger post 38 essentially forms an enlarged free end of the thumb trigger 36. The trigger post 38 is positioned to overlay the back side of the handle 12 as near the upper end of the handle as best seen in FIG. 3 when the bowstring hook is in the closed position shown in FIG. 1.

The above-described elements of the thumb trigger release 10 are conventional and so will not be described in further detail.

Extending from the upper end of the handle 12 away from the back side of the handle 12 is a cantilevered arm 40 rigidly attached to the handle 12. As the arm 42 extends away from the handle, it also extends to the left side of the handle 12 as viewed in FIG. 3. A thumb assist 42 is rigidly attached to the free end of the arm 42 and extends from the arm 42 away from the handle 12 and the trigger post 38. The thumb assist is located on the back side 16 of the handle.

The thumb assist 42 is formed as an elongate knurled post or cylindrical member extending along a longitudinal axis 44. The arm 28 positions the thumb assist closely adjacent to the trigger post 24 and coaxial with the trigger post. The thumb assist 28 has an exposed outer surface that is spaced away from the handle 12 and engageable by the thumb of the archer's hand holding the release 10. The thumb assist is not used to trigger the release, but is used instead to receive force from the thumb assisting in drawing the bowstring and holding the drawn bowstring under tension prior to release.

The arm 40 and the thumb assist 43 are not in the path of movement of the trigger 36 and do not interfere with operation of the trigger mechanism or release of the bowstring.

Use of the thumb trigger release 10 is identical to the unmodified, conventional thumb trigger release except that the archer places the thumb of the hand holding the release against the thumb assist while drawing the bowstring. The thumb can now apply force to the release 10 assisting in generating draw force and holding the bowstring under tension as previously described. The thumb moves off the thumb assist 42 and engages the trigger post 38 to actuate the trigger mechanism and release the bowstring.

The illustrated thumb trigger release is intended for right-hand use hand and so the thumb assist is located to the left of the trigger post as shown in FIG. 3. In other embodiments the thumb assist is located on the right side of the trigger post as viewed in FIG. 3 for left-hand use.

FIGS. 5-8 illustrate an index finger trigger release 110 that is otherwise identical to the thumb trigger release 10.

The index finger trigger release 110 includes the same conventional features as the thumb trigger release 10, except that the trigger 36 extends from the side of the release head and faces the index finger grip 20 from the front side 18 of the handle 12 and does not include a trigger post. The trigger 36 is curved in a conventional manner to facilitate operation by the index finger of the archer.

The cantilevered arm 40 and the thumb assist 42 are identical to the arm and the thumb assist of the release 10.

In use, the archer's thumb is supported against the thumb assist 42 as previously described and enables the archer's thumb to generate force assisting in drawing and holding the bowstring as previously described. The thumb remains against the thumb assist when the index finger moves off the index finger grip 20 to engage the trigger 36.

The applicant has found that enabling the thumb to generate and contribute draw force enables greater and smoother draw of the bowstring even though the thumb or index finger must be moved off the handle to trigger the release.

Figure 9:
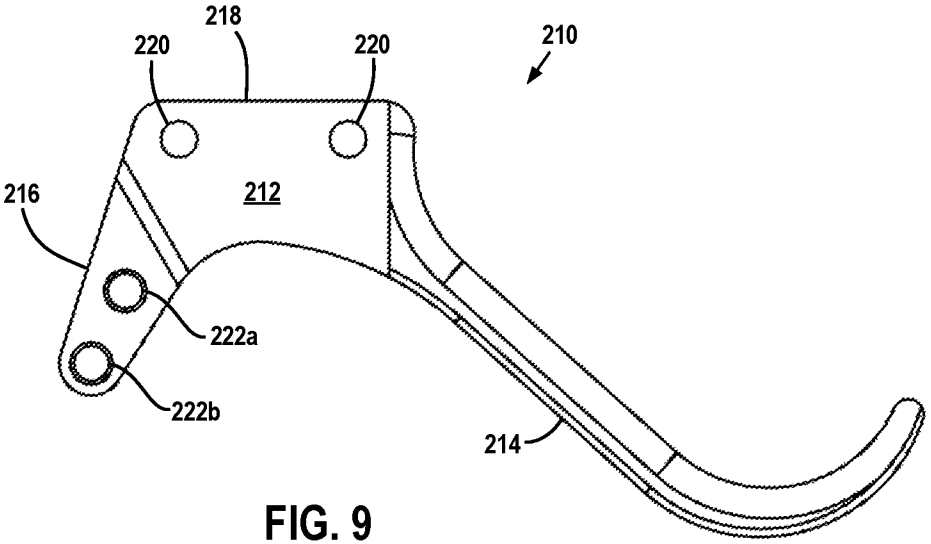
FIG. 9 is a top view of a handle for a bow trigger release, the handle having the thumb assist removed.

FIG. 9 illustrates a portion of a rigid handle 210 for an archery release. The handle is generally plate-like and has a central portion 212, a finger grip 214 extending away from one side of the central portion, and a thumb-assist mounting portion 216 extending away from the other, opposite side of the central portion.

The central portion 212 includes a flat mounting surface 218 extending across the thickness of the central body portion. The mounting surface mounts or locates a release head (not shown) to the handle. A pair of through-holes 220 are used in the illustrated embodiment for fastening a strap to the handle that press the release head against the mounting surface 218. This form of removably mounting a release head to a handle with a strap is conventional and so will not be described in further detail. Other conventional methods for removably fastening a release head to a handle surface may be used in alternative embodiments of the archery release.

The handle 210 itself does not include a trigger release; the release head would include a trigger release. The trigger release may be similar to the trigger release 36 shown in FIG. 5 but may extend from the release head to face the finger grip 214.

The finger grip 214 is conventional and will not be described in further detail.

The thumb-assist mounting portion 216 extends away from the mounting surface 218 as it extends away from the central handle portion 212. A pair of threaded through-holes 222*a*, 222*b* extend through the thickness of the mounting portion 216. The holes 222*a*, 222*b* are sized to receive the threaded end of a thumb assist (not shown) similar to the thumb assist 42 shown in FIG. 3. The thumb-assist is rigidly but removably attached to the handle by threading the thumb assist into either end of a hole 222 depending on the preference of the user. The thumb assist when attached to the handle would extend in a direction perpendicular to the drawing sheet as viewed in FIG. 9.

The inner hole 222*a* is located closer to the mounting surface 218 and is located nearer the finger grip 214 than is the outer hole 222*b*. This enables the handle 210 to comfortably accommodate a range of hand sizes. The user can select the hole 222 best suited for his or her hand size. An archer with a smaller hand would select the hole 222*a* and an archer with a larger hand would select the hole 222*b*.

In use, the archer's thumb is supported against the thumb assist as previously described to generate force assisting in drawing and holding the bowstring. The archer's thumb remains against the thumb assist when the index finger moves off the grip 214 to engage the trigger of the release head.

The shape, position, range of motion of the trigger of conventional finger trigger releases vary among possible embodiments. The relative position of the thumb assist with respect to the handle or trigger can vary in different embodiments to compensate for differences in trigger and handle design among the embodiments. The handle can be made as "one size fits all" or in various sizes for men, women, or children. The thumb assist may be removable and may have multiple mounting positions available on the archery release.

While one or more embodiments have been disclosed and described in detail, it is understood that this is capable of modification and that the scope of the disclosure is not limited to the precise details set forth but includes modifications obvious to a person of ordinary skill in possession of this disclosure, including (but not limited to) changes in material selection, size, operating ranges environment of use, and also such changes and alterations as fall within the purview of the following claims.

What is claimed is:

1. A trigger release for archery comprising:

a rigid handle extending along a longitudinal axis, the handle having opposite first and second sides on opposite sides of the axis;

a release head extending from the first side of the handle in a direction generally perpendicular to the longitudinal axis;

a trigger mechanism at least partially disposed in the release head, the trigger mechanism comprising an exposed trigger;

a thumb assist rigidly attached to the handle, the thumb assist having an exposed surface spaced away from the handle and engageable by the thumb of an archer holding the handle.

2. The trigger release of claim 1 wherein the thumb assist is located on the back side of the handle.

3. The trigger release of claim 1 comprising an arm rigidly attached to the handle and extending away from the handle to a free end, the thumb assist attached to the arm.

4. The trigger release of claim 3 wherein the arm extends from an upper end portion of the handle.

5. The trigger release of claim 4 wherein the handle comprises an index finger grip forming the upper end portion of the handle.

6. The trigger release of claim 1 wherein the trigger extends away from the back side of the handle to a free end located on the back side of the handle.

7. The trigger release of claim 6 wherein the thumb assist is adjacent to the free end of the trigger when the trigger mechanism is retaining the bowstring.

8. The trigger release of claim 7 wherein the thumb assist is an elongate member extending along an axis, the thumb assist axis intersecting the free end of the trigger.

9. The trigger release of claim 1 wherein the trigger extends from the release housing to a free end of the trigger disposed on the front side of the housing.

10. The trigger release of claim 9 wherein the handle comprises an index finger grip and the trigger faces the index finger grip.

11. The trigger release of claim 1 wherein the release head is removably fastened to the handle.

12. The trigger release of claim 1 wherein the thumb assist is removably attached to the handle.

13. The trigger release of claim 12 wherein the thumb assist is attached to the handle by a threaded connection.

14. The trigger release of claim 13 wherein the threaded connection comprises a first threaded bore extending into the handle.

15. The trigger release of claim 14 comprising a second threaded bore extending into the handle, the thumb assist threadable into the second threaded bore.

16. The trigger release of claim 15 wherein the first and second bores are spaced different distances from the trigger.

17. The trigger release of claim 14 wherein the first threaded bore extends between opposite open ends, the thumb assist threadable into either open end.

* * * * *